US008541703B2

(12) United States Patent
Noori Motlagh

(10) Patent No.: US 8,541,703 B2
(45) Date of Patent: Sep. 24, 2013

(54) AUTOMATIC VIBRATIONAL ELECTRICAL SWITCH DEVICE

(76) Inventor: Alireza Noori Motlagh, Tehran (IR)

( * ) Notice: Subject to any disclaimer, the term of this patent is extended or adjusted under 35 U.S.C. 154(b) by 234 days.

(21) Appl. No.: 12/873,465

(22) Filed: Sep. 1, 2010

(65) Prior Publication Data

US 2012/0048691 A1 Mar. 1, 2012

(51) Int. Cl.
*H01H 35/14* (2006.01)

(52) U.S. Cl.
USPC ..... 200/61.5; 200/61.45 R

(58) Field of Classification Search
USPC ..... 200/61.45 R, 61.5, 61.46; 340/690
See application file for complete search history.

(56) References Cited

U.S. PATENT DOCUMENTS

| | | | | | |
|---|---|---|---|---|---|
| 2,056,494 | A | * | 10/1936 | Tucker, Jr. et al. | 200/61.45 R |
| 3,733,448 | A | * | 5/1973 | Brady | 200/61.45 R |
| 3,743,803 | A | * | 7/1973 | Roesch et al. | 200/61.45 R |
| 3,798,399 | A | * | 3/1974 | Corporandy | 200/61.45 R |
| 4,859,818 | A | * | 8/1989 | Landais | 200/61.45 R |
| 5,481,139 | A | * | 1/1996 | Lucas | 200/61.45 R |
| 5,747,761 | A | * | 5/1998 | Masuda | 200/61.45 R |
| 6,166,339 | A | * | 12/2000 | Bechis | 200/61.45 R |

* cited by examiner

*Primary Examiner* — Felix O Figueroa
(74) *Attorney, Agent, or Firm* — Barry Choobin; Patent360 LLC

(57) ABSTRACT

The various embodiments of the present invention provide an automatic vibrational electrical switch device that includes a shell, a first sphere, a transient sphere and a pressure switch. The pressing operation of the transient sphere towards an upward direction results in placing the first sphere load over pressure switch to keep the electric switch in a normal mode and when any vibration occurs in a normal mode the first sphere load is released and the electric switch is automatically operated in a quake mode.

12 Claims, 8 Drawing Sheets

AUTOMATIC VIBRATIONAL ELECTRICAL SWITCH DEVICE

BACKGROUND

1. Technical field

The embodiments herein generally relates to an electrical switch. The embodiments herein particularly relates to an automatic vibrational electric switch. The embodiments herein more particularly relates to the automatic vibrational switch for use in domestic field to react in sudden incidents such as earth quakes to minimize the hazards and damages due to fire in the environment.

2. Description of the Related Art

In the current scenario, earthquakes have become common across the world due to which there is a lot of damage to the humans. During earthquakes, there is a higher probability for the breakage of the gas pipes thereby initiating the leakage of gas and generating a lot of damages to the things and the fire that breaks out due to gas leakage may not be avoided. Further it is very difficult to control and extinguish the fire until the fire fighting officers reach in time during earth quake period. In such a scenario, there needs an efficient technique to solve the problems that occurs during natural disasters. Further in the existing technique, the switches that are installed in the houses may not react at once/immediately during sudden incidents and the leakage of gas, water, oil, application of security systems, and the electricity may not be cut off causing a lot of damage to the environment.

Hence there is a need for an automatic vibrational electrical switch installed within houses that reacts in sudden incidents and natural disasters and minimizes hazards, any financial damages and fire in the environment.

The abovementioned shortcomings, disadvantages and problems are addressed herein and which will be understood by reading and studying the following specification.

OBJECTS OF THE EMBODIMENTS

The primary object of the embodiments herein is to provide a vibrational electrical switch that is operated in a normal mode during normal and regular use periods and in a quake mode to cut off a power supply to the electrical appliances when any vibration occurs or during earth quakes.

Another object of the embodiments herein is to provide a vibrational electric switch to regulate and cut off power supply to the domestic electrical appliances and systems in the quickest possible time.

Yet another object of the embodiments herein is to develop a vibrational electric switch to provide an earthquake security system to the electrical appliances.

Yet another object of the embodiments herein is to develop a vibrational electric switch to provide remedial measures to the electrical appliances against earthquake and sudden shakes in the quickest possible time.

Yet another object of the embodiments herein is to develop a vibrational electric switch to cut off electrical power supply to the electrical appliances provide remedial measures to the electrical appliances in the quickest time in different situations such as earthquake, explosion, and in the time of gas, electricity, chemical materials, oil, and water leakage, etc.

SUMMARY

The various embodiments herein provide a vibrational electrical switch device that includes a shell, a first sphere, a transient sphere, and a pressure switch. The electrical switch is operated in normal mode and in quake mode. The pressure switch is operated in a normal mode and in a quake mode. The pressing operation of the transient sphere towards an upward direction results in placing the first sphere over the pressure switch to keep the pressure switch in a normal mode. When any vibration occurs in a normal mode, the first sphere is released and the pressure switch is automatically operated in a quake mode.

According to one embodiment herein, a vibrational electrical switch includes the pressure switch. The pressure switch includes a pressure bar, a spring placed underneath the pressure bar, a metal blade connected to one end of the pressure bar and a plurality of electrical connection bars.

According to one embodiment herein, a vibrational electric switch includes a transient sphere. The transient sphere is designed in such a way to place the first sphere over the pressure bar of the pressure switch. The end section of the pressure bar over which the first sphere is placed, is a vibrating section of the electric switch.

According to one embodiment herein, the pressure bar is adapted to flip the metal blade in an upward direction and a downward direction to change a direction of flow of electricity. The metal blade performs the action of disconnecting and connecting an electrical power supply within the electric switch. The spring is adapted to activate the pressure bar within the switch automatically and dynamically. The plurality of electrical connection bars includes at least four connection bars for an input and an output of an electrical power.

The vibrating rate of the pressure bars during the quake mode depends on a diameter of the pressure bar in the pressure switch. The pressure switch divides the electric current to perform at least one of the normal mode operation and the quake mode operation.

According to one embodiment herein, a vibrational electrical switch includes the shell. The shell includes a board to hold the internal components of the electrical switch, a lid arranged above the board to enclose the internal components of the electrical switch.

The vibrational electrical switch includes a sphere load. The sphere load is a weight provided to protect the pressure switch in the normal mode and for connecting electric current during the normal mode. The electrical switch is in a standby mode and no vibrations are occurred during a normal mode of operation. The electrical switch automates the flow of electricity when a vibration occurs during a quake mode of operation. The vibration occurred during the normal mode results in a change of flow of electric current to one or more devices.

These and other objects and advantages of the embodiments herein will become readily apparent from the following detailed description taken in conjunction with the accompanying drawings.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
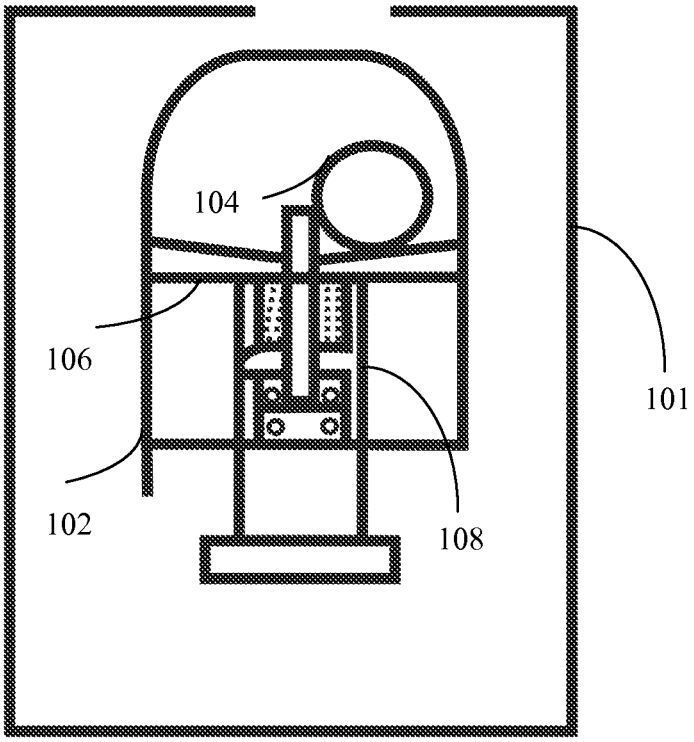
FIG. 1 illustrates an exploded view of an automatic vibrational electrical switch, according to one embodiment.

Although the specific features of the embodiments herein in some drawings and not in others. This is done for convenience only as each feature may be combined with any or all of the other features in accordance with the embodiments herein.

DETAILED DESCRIPTION OF THE EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a vibrational electrical switch device that includes a shell, a first sphere, a transient sphere, and a pressure switch. The electrical switch is operated in normal mode and in quake mode. The pressing operation of the transient sphere towards an upward direction results in placing the first sphere load over a pressure switch to keep the electrical switch in a normal mode. When any vibration occurs in a normal mode the first sphere load is released and the electric switch is automatically operated in a quake mode.

According to one embodiment herein, a vibrational electrical switch includes the pressure switch. The pressure switch includes a pressure bar, a spring placed underneath the pressure bar, a metal blade connected to one end of the pressure bar and a plurality of electrical connection bars.

According to one embodiment herein, a vibrational electric switch includes a transient sphere. The transient sphere is designed in such a way to place the sphere load over the pressure bar of the pressure switch. The end section of the pressure bar over which the sphere load is placed, is a vibrating section of the electric switch.

According to one embodiment herein, the pressure bar is adapted to flip the metal blade in an upward direction and a downward direction to change a direction of flow of electricity. The metal blade performs the action of cutting and connecting electricity within the electric switch. The spring is adapted to activate the pressure bar within the switch automatically and dynamically. The plurality of electrical connection bars includes at least four connection bars for an input and an output of an electrical power.

The vibration rate of the pressure bars during the quake mode depends on a diameter of the pressure bar in the pressure switch. The pressure switch divides the electric current to perform at least one of the normal mode operation and the quake mode operation.

According to one embodiment herein, a vibrational electrical switch includes the shell. The shell includes a board to hold the internal components of the electrical switch, a lid connected to the board to enclose the internal components of the electrical switch.

The vibrational electrical switch includes a sphere load. The sphere load is a weight provided to protect the pressure switch in the normal mode and for connecting electric current during the normal mode. The electric switch is in a standby mode and no vibrations are occurred during a normal mode of operation. The electric switch automates the flow of electricity when a vibration occurs during a quake mode of operation. The vibration occurred during the normal mode results in a change of flow of electric current to one or more devices.

FIG. 1 illustrates an exploded view of an automatic vibrational electric switch according to one embodiment. With respect to FIG. 1, the automatic vibrational electric switch 101 includes a shell 102, a sphere 104, a transient sphere 106, and a pressure switch 108. The shell 102 protects the internal members of the automatic vibration electric switch 101 against dust, soil, wind and rain. The shell 102 also connects the automatic electric vibrational switch 101 to the socket in the wall. The sphere 104 in the automatic vibration electric switch 101 enforces pressure on the bar of the pressure switch 108 in standby fashion and reacts against vibration. The bars are the point of connection with the metal blade and an electric division. The sphere 104 load is a weight to protect the pressure switch in the normal mode and for connecting electric current during the normal mode.

The transient sphere 106 places the sphere 104 over the bar of the pressure switch 108 and the pressure switch 108 divides the electricity received into two clusters.

Figure 2:
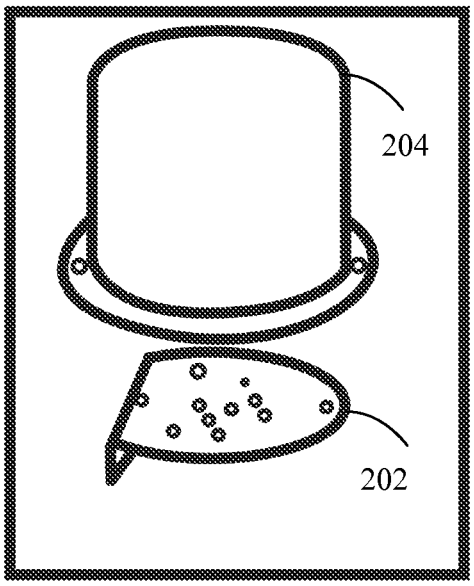
FIG. 2 illustrates an exploded view of a shell in an automatic vibrational electrical switch, according to one embodiment.

FIG. 2 illustrates an exploded view of a shell in an automatic vibrational electrical switch, according to one embodiment. With respect to FIG. 2, the shell 102 protects the internal members of the automatic vibration electric switch 101 against dust, soil, wind and rain. The shell 102 of the electric switch includes a board 202 and a lid 204. The internal parts of the switch are placed over the board 202 and are connected to the wall. The lid 204 is situated over the switch parts and is connected to the board 202. The board 202 and the lid 204 of the shell 102 holds the various parts of the switch and protects them against dust, soil, wind and rain.

The board 202 is a circular sheet having a diameter of 120 mm and a thickness of 6 mm. Further the board 202 includes a base for installing the shell 102 on the wall with the height of 50 mm. The lid 204 of the shell 102 is cylindrical in shape having a height of 125 mm and internal diameter of 90.5 mm.

For example, the diameter of the sphere 104 is 32 mm and the diameter of the transient sphere 106 is 90 mm with an external thickness of 10 mm in over the circular sheet. The central thickness of the transient sphere 106 sheet is 5 mm and the diameter of the central bore of the transient sphere 106 sheet is 7.5 mm. Further the cylindrical height from underneath the transient sheet until the installation place of toe is 80 mm and the internal diameter of the cylinder is 34.5 mm. The diameter of the toe installed over the cylinder is 10 m.

A cylindrical joint with a rectangular joint underneath it is placed over the body of the cylindrical pressure switch 108. For example, the diameter of the frame is 34 mm and the height is 50 mm. Further the diameter of the cylindrical joint over the frame is 25.5 mm and rectangular joint underneath the frame is 25.5 mm. The width of the rectangular joint is 10 mm. The diameter of the spring and the diameter of the pressure bar are 0.5 mm and 7 mm respectively. The height of the pressure bar is 55 mm and the diameter of the metal blade is 2 mm. The height and width of the metal blade is equal to 8×23 mm. The diameter of the bore inside the frame of the pressure switch 108 is 7.5 mm and the height is 10 mm. As a result, the depth of the two upper and lower joints of the frame is 20 mm and the installation distance of metal bars is equal to 8×18. The dimensions of the components in the automatic vibration electric switch 101 can be modified, but the design of each of the components is kept precise and forms the base for designing the automatic vibrational electric switch 101 in different sizes according to the user requirements.

Figure 3:
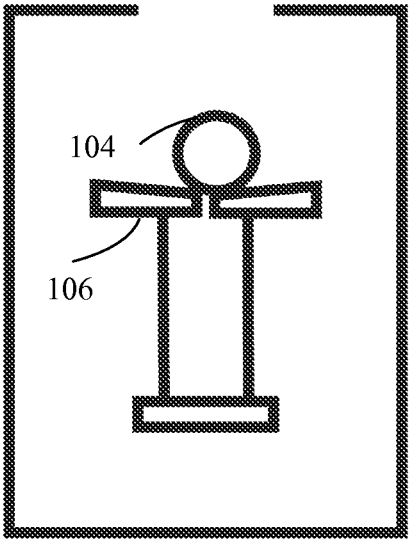
FIG. 3 illustrates an exploded view of an automatic vibrational electrical switch with a sphere and a transient sphere, according to one embodiment.
Figure 4:
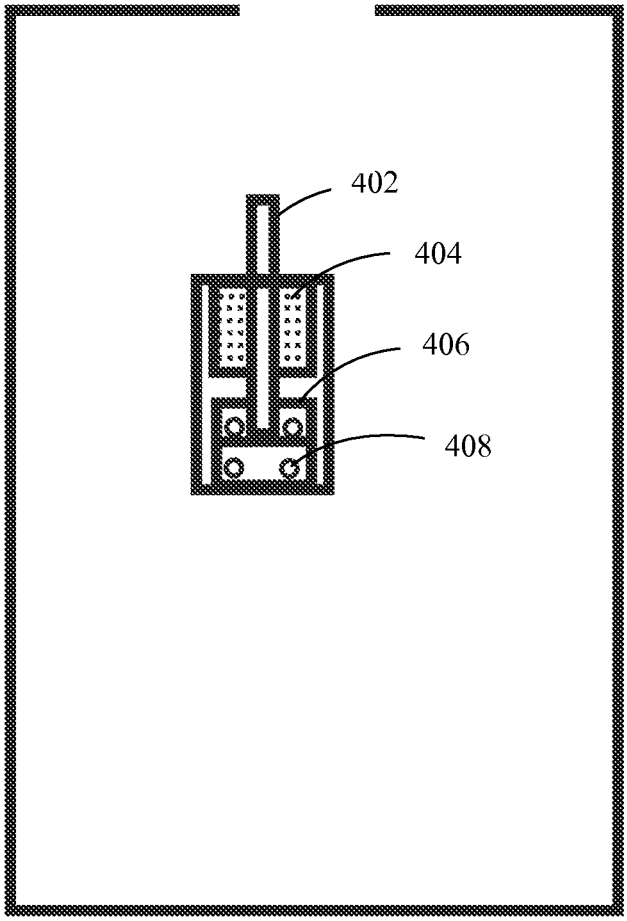
FIG. 4 illustrates an exploded view of an electric pressure switch, according to one embodiment.

FIG. 3 illustrates an exploded view of an automatic vibrational electrical switch with a sphere and a transient sphere according to one embodiment, while FIG. 4 illustrates an exploded view of an electric pressure switch according to one embodiment. With respect to FIG. 3 and FIG. 4, the automatic vibrational electric switch includes the pressure bar 402, a spring 404, a metal blade 406, one or more bars 408. The body of the pressure switch 108 places the pressure bar 402, the spring 404, the metal blade 406, and the electricity connection bars in the due places of the automatic vibrational electric switch 101. The sphere 104 in the automatic vibration electric switch 101 enforces pressure on the bar of the pressure switch 108 in standby fashion and reacts against vibration. The pressure bar 402 is the point of connection with the metal blade 406 and an electric division.

The sphere 104 acts as a weight and is used for protecting the pressure switch 108 and connecting the electric current during the normal mode. During the normal mode, the transient sphere places the sphere load over the bar of pressure switch and is dynamic in up and down mode as shown in FIG. 3.

The pressure switch 108 divides the electricity received into two clusters and performs the task of moving the metal blade 406 up and down. The pressure switch 108 also changes the direction of the electricity in the switch. The pressure switch 108 holds the pressure bar 402, the spring 404, the metal blade 406 and the electric connection bars 408 as shown in FIG. 4.

The automatic vibrational electric switch 101 includes the spring 404 for performing the action of automating and dynamiting the pressure bar 402 as shown in FIG. 4. The pressure bar 402 is adapted to flip the metal blade 406 in an upward direction and a downward direction to change a direction of flow of electricity.

The metal blade 406 performs the action of cutting and connecting electricity within the switch. The vibration rate in the automatic vibrational electric switch 101 depends on the diameter of the bar and also on the curved end of the bar. The diameter of the one or more bars 408 can be modified based on the requirements.

Figure 5:
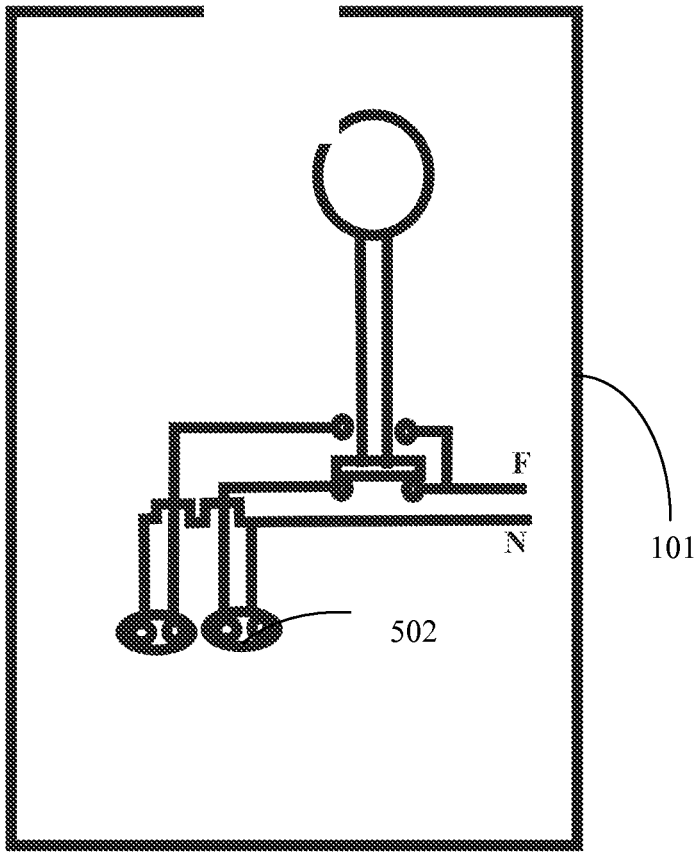
FIG. 5 illustrates an exploded view of the circuit of an automatic vibrational electric switch in a normal and a standby mode, according to one embodiment.
Figure 6:
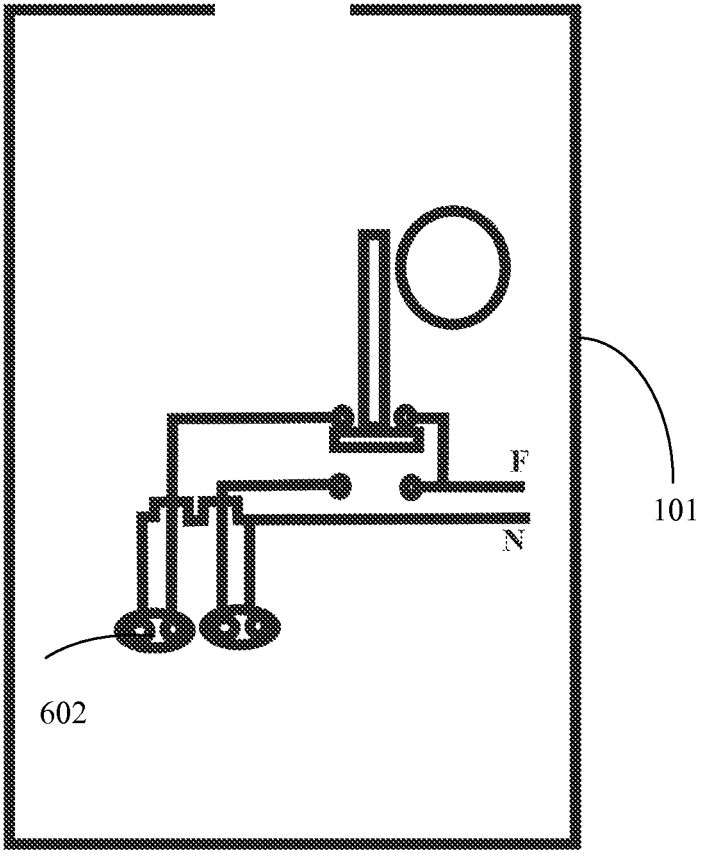
FIG. 6 illustrates an exploded view of an electric pressure circuit in a quake and a vibration mode in an automatic vibrational electric switch, according to one embodiment.

FIG. 5 illustrates an exploded view of an electric pressure circuit in a normal mode and a standby mode according to one embodiment, while FIG. 6 illustrates an exploded view of an electric pressure circuit in a quake mode and a vibration mode according to one embodiment. With respect to FIG. 5, the automatic vibrational electric switch functions in two modes namely the normal mode 502 and the standby mode. The electricity is connected to the switch in the normal mode 502 and the switch is always in standby for reacting during an earthquake and a shock.

When a vibration is occurred exceeding the common rate, the automatic vibration electric switch 101 functions in the quake mode 602. The automatic vibration electric switch 101 uses the electricity for the meant purpose in the normal mode 502. During the normal mode 502, no vibration occurs and the automatic vibration electric switch 101 is in standby and the electricity is used for systems and technologies to operate normally.

The pressing operation of the transient sphere 106 switch towards upward direction leads to placing the sphere 104 load over the pressure bar and keeps the automatic vibrational electric switch 101 in the standby mode. Further when any vibration occurs in the normal mode 502, the sphere load is released and the electric switch is automatically operated in a quake mode 602. The vibrational section of the switch is the end of electric current pressure bar 402 and the sphere 104 load is placed as shown in FIG. 5. When the vibration occurs in the quake mode 602, the electricity supply to the dangerous systems and technologies are cut and security technologies are launched depend on the speed of electricity as shown in FIG. 6.

Figure 7:
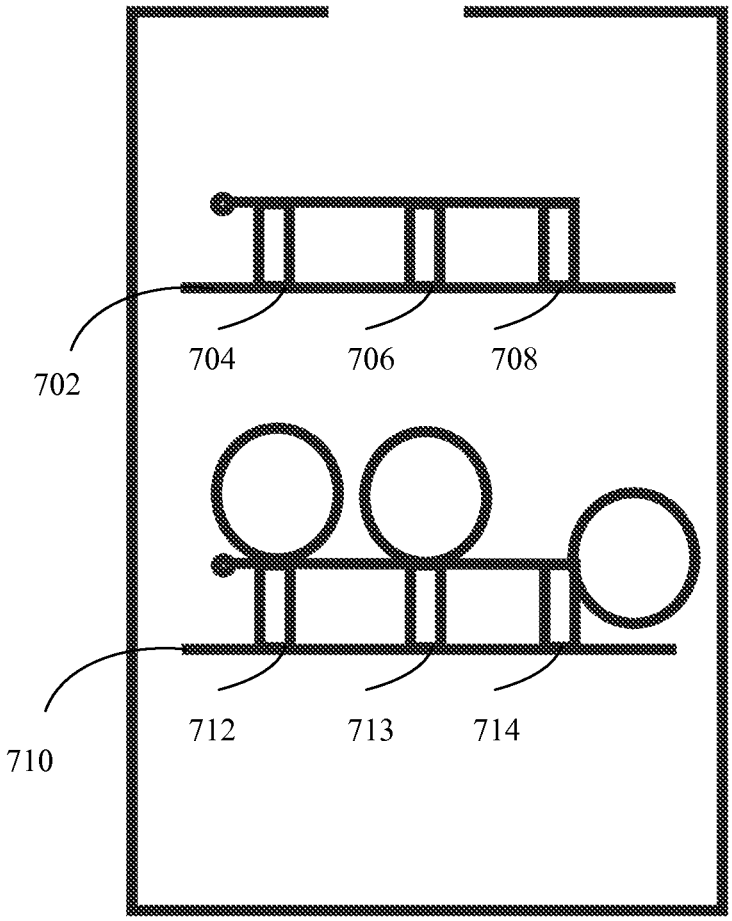
FIG. 7 illustrates an exploded view of the three states of the bar end and the three states of the sphere over the bar in an automatic vibrational electrical switch, according to one embodiment.
Figure 8:
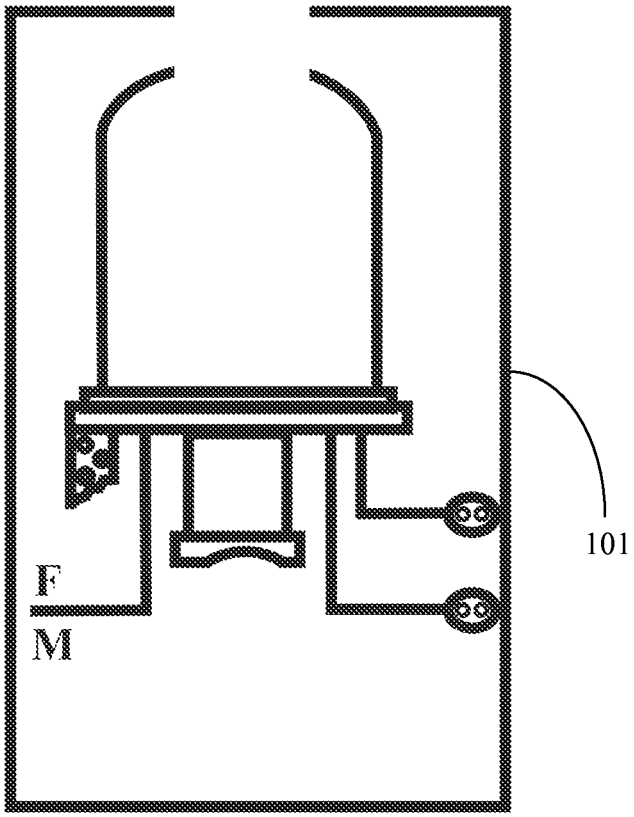
FIG. 8 illustrates a perspective view of an automatic vibrational electric switch, according to one embodiment.

FIG. 7 illustrates an exploded view of the three states of the bar end and the three states of the sphere over the bar according to one embodiment, while FIG. 8 illustrates a perspective view of an automatic vibrational electric switch 101 according to one embodiment. With respect to FIG. 7, the three states of the bar end 702 includes a flat end 704, a hollow end 706 and a prominent end 708. The vibration rate of the automatic vibration electric switch 101 in horizontal fashion depends on the diameter of the bar. The diameter of the bar in the switch is 7 mm. Further since the sphere load is placed over the pressure of the bar, the load of the weight is imposed vertically on the bar and radius of the bar is the falling points of the weight as shown in FIG. 7.

The three states of the sphere 710 over the bar include a balanced state 712, a standing state 713 and a falling always state 714. In first mode, the bar end is flat and the sphere 104 stands balanced over the bar. In second mode, the bar end is hollow and the sphere 104 sits on the pressure bar 402. In third mode the bar end is protruded and the sphere falls always.

The distance between the vertical points of the load up to the falling point of the weights shows the vibration rate in horizontal fashion. The vibration height of the switch depends on the curvature of the end of the bar as shown in FIG. 7. Further for representing the vibration height, the three modes of the bar namely the first mode, the second mode and the third mode are considered as the end.

With respect to FIG. 7, the automatic vibrational electric switch 101 is used for application of systems and for earthquake security technologies in the quickest possible time. The automatic vibrational electric switch provides the technological fight facility against the earthquake and sudden shakes in the environment. The automatic vibrational electric switch provides the possibility of controlling dangerous technologies and applications of technologies in the quickest time in different situations such as an earthquake, an explosion and during the time of leakage of gas, chemical materials, oil, and water.

The automatic vibrational electric switch reacts against sudden shocks and minimizes the financial damages in quickest possible time during earthquake and sudden explosions.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A vibrational electrical switch device comprising: a shell; a first sphere; a transient; and a pressure switch;

wherein the first sphere, the transient and the pressure switch are located inside the shell, wherein the pressure switch comprises a pressure bar, a spring placed underneath the pressure bar and biasing the pressure bar in an upward direction; a metal blade connected to a lower end of the pressure bar, and a plurality of connection bars, wherein the metal blade provides an electrical connection between at least two of the pressure bars, wherein the pressure switch is operated in a normal mode and in a quake mode;

wherein a pressing operation of the transient from an initial resting position towards the upward direction results in placing the first sphere over the pressure bar of the pressure switch so that the pressure switch operates in a normal mode;

wherein the transient returns to the initial resting position so that the first sphere seats over the pressure bar and is solely supported by the pressure switch and when a vibration occurs during the normal mode of operation, the first sphere is released from the pressure bar and the pressure switch is automatically turned to a quake mode.

2. The vibrational electrical switch device according to claim 1, wherein the shell comprises: a board to hold a plurality of internal components; and a lid arranged above the board to enclose the internal components.

3. The vibrational electrical switch device according to claim 1, wherein the first sphere is a weight to protect the pressure switch in the normal mode and for connecting electric current during the normal mode.

4. The vibrational electrical switch device according to claim 1, wherein the transient is designed in such a way to place the first sphere over the pressure bar of the pressure switch.

5. The vibrational electrical switch device according to claim 1, wherein an end section of the pressure bar over which the first sphere is placed is a vibrating section.

6. The vibrational electrical switch device according to claim 1, wherein the pressure bar is adapted to flip the metal blade in an upward direction and a downward direction to change a direction of flow of electricity.

7. The vibrational electrical switch device according to claim 1, wherein the metal blade performs the action of disconnecting and connecting an electrical power supply.

8. The vibrational electrical switch device according to claim 1, wherein the spring is adapted to activate the pressure bar automatically and dynamically.

9. The vibrational electrical switch device according to claim 1, wherein the plurality of electrical connection bars include at least four connection bars for an input and an output of an electrical power.

10. The vibrational electrical switch device according to claim 1, wherein a vibration rate of the pressure bar during the quake mode depends on a diameter of the pressure bar in the pressure switch.

11. The vibrational electrical switch device according to claim 1, wherein the pressure switch divides the electric current to perform at least one of the normal mode operation and the quake mode operation.

12. The vibrational electrical switch device according to claim 1, wherein the vibration during the normal mode results in a change of flow of electric current to one or more devices.

* * * * *